US005240078A

United States Patent [19]

Worthington

[11] Patent Number: 5,240,078

[45] Date of Patent: Aug. 31, 1993

[54] MOBILE MODULAR FOAM FIRE SUPPRESSION APPARATUS, SYSTEM AND METHOD

[75] Inventor: Robert F. Worthington, Artesia, N. Mex.

[73] Assignee: Navajo Refining Company, Artesia, N. Mex.

[21] Appl. No.: 759,326

[22] Filed: Sep. 13, 1991

[51] Int. Cl.[5] ..... A62C 27/00

[52] U.S. Cl. ..... 169/47; 169/14; 169/16; 169/52; 169/67

[58] Field of Search ..... 169/13, 14, 15, 16, 169/46, 47, 52, 24, 67

[56] References Cited

U.S. PATENT DOCUMENTS

| | | | |
|---|---|---|---|
| 3,220,482 | 11/1965 | Eveleth | 169/52 X |
| 4,037,664 | 7/1977 | Gibson | 169/24 X |
| 4,436,487 | 3/1984 | Purvis et al. | 169/13 X |
| 4,729,434 | 3/1988 | Rohrbach | 169/24 |
| 4,875,526 | 10/1989 | Latino et al. | 169/24 |

FOREIGN PATENT DOCUMENTS

| | | | |
|---|---|---|---|
| 1385918 | 3/1975 | United Kingdom | 169/24 |

OTHER PUBLICATIONS

FIG. 3-1, Typical Balanced Pressure (foam liquid pump type) Proportioning Arrangement, *National Foam*, Rev. Aug. 1985, pp. 3-4.

"Low Expansion Foam/Combined Systems", 1988 Edition, pp. 11-22.

*Primary Examiner*—David M. Mitchell
*Assistant Examiner*—Andrew C. Pike
*Attorney, Agent, or Firm*—Jefferson Perkins

[57] ABSTRACT

A mobile modular foam fire suppression apparatus includes a movable platform. Supplies of foam concentrate and water are remote from the platform. A foam concentrate pump mounted on the platform pumps foam concentrate from a remote supply, such as a foam concentrate tank or tailer, to a water/foam proportioner on the platform. Water is provided under pressure from sources such as pumper trucks to a water inlet of the water/foam proportioner. The proportioner mixes the water and the foam concentrate to form a foam solution, which may then be applied to a fire with any of several foam solution discharge devices. Preferably, the apparatus also includes a foam concentrate return line which returns excess foam concentrate back to the remote supply of foam concentrate. This return line has a pressure regulator which regulates the pressure in a portion of the foam concentrate return line to a predetermined value. The apparatus provides an inexpensive way to manufacture and apply to fires large quantities of foam solution.

22 Claims, 4 Drawing Sheets

MOBILE MODULAR FOAM FIRE SUPPRESSION APPARATUS, SYSTEM AND METHOD

TECHNICAL FIELD OF THE INVENTION

The present invention relates to mobile fire suppression apparatus, and, more particularly, to a mobile modular foam fire suppression apparatus designed for use where high volume water or foam solution application rates and densities are required.

BACKGROUND OF THE INVENTION

Fighting large fires, particularly in environments where fires can spread rapidly, requires use of high volume water or foam solution application rates and densities.

In-line balanced pressure proportioning modules are well known in the art. These in-line balanced pressure proportioning modules are located at a point in the fire suppression system to accurately supply proportioned foam solution. The principle of operation is based on the use of two orifices: one for the water supply and one for the foam liquid supply, with both orifices discharging into a common reduced pressure area. The water is supplied by a water pump at the required pressure, and the foam liquid is supplied from another pump or other pressure source. These proportioners automatically balance the foam liquid pressure and water pressure to provide correct proportioning, even though the water pressure may vary at points in the system. In-line balanced pressure proportioning modules are available on the market from such manufacturers as National Foam, 150 Gordon Drive, Lionville, Pa. 19353.

Fighting large industrial fires, such as those involving storage tanks in petroleum refineries and petrochemical complexes, often requires foam solution discharges in the range of 5000 gallons per minute (GPM). Currently, foam solution discharge rates in this range require the use of four to five industrial foam pumpers at a cost of $175,000 to $200,000 each. Using state-of-the-art equipment available on the market today, fighting a single fire can easily require a capital investment of up to $1,000,000.

Accordingly, conventional fighting of these large scale fires requires significant capital expenditures. Once the fire spreads, the possibility for ordering additional fire fighting equipment arises; the consequent delay hampers efficiency. It has therefore become desirable to devise an economical way of fighting large scale fires in an efficient and effective manner.

SUMMARY OF THE INVENTION

According to one aspect of the invention, a modular fire suppression apparatus includes a movable platform. A foam concentrate pump is mounted on the platform and has an inlet and an outlet. Means mounted on the platform, such as a diesel engine, are coupled to the pump for powering the pump. A water/foam proportioner on the platform has a water inlet, a foam concentrate inlet and a foam solution outlet. The foam concentrate inlet is coupled to the outlet of the pump. A water intake manifold is mounted on the platform and has a plurality of water intakes. The intake manifold has an outlet coupled to the water inlet of the proportioner. A plurality of foam solution outlets are mounted on the platform and coupled to the foam solution outlet of the proportioner to deliver foam to the fire.

According to another aspect of the invention, the platform may comprise a skid, either alone or in combination with a wheeled vehicle, such as a trailer, with opposed first and second sides and a third side connecting the first and second sides. Each of the first and second sides has a plurality of foam solution discharge outlets, a foam concentrate intake line, and a foam concentrate return line. The third side, such as the rear of the trailer, is fitted with a water inlet manifold that is capable of coupling a plurality of water hoses to the inlet of the foam proportioner.

According to a third aspect of the invention, the mobile platform is connected to a foam concentrate supply vessel through an intake line and a return line. A plurality of water supply vehicles, such as standard municipal fire department pumper trucks, each has hoses connected to the water intake manifold. Fire hoses discharging the foam solution onto the fire may run from either side from the platform. Optionally, a foam monitor may be installed on the platform in order to obtain foam solution discharge directly from the platform itself. Where the platform is fitted with a foam concentrate return line, a pressure regulating valve is inserted into the line in order to insure that the pressure at the foam concentrate inlet of the foam/water proportioner is at or above a predetermined value.

The present invention confers several technical advantages over the prior art, which, in combination, yield an effective apparatus, system, and method of fighting large fires at costs substantially lower than have heretofore been known in the art. One important advantage is the ability to deliver quantities of fire suppression foam at a rate of 10,000 GPM. The invention is designed to deliver large quantities of foam solution to multiple dispensing appliances, including handlines, monitors, sprinklers, foam chambers, or high-back-pressure foam makers for sub-surface injection. The present invention is a solution to the problem obtaining a large-volume foam delivery system which is both mobile and economical.

BRIEF DESCRIPTION OF THE DRAWINGS

Further aspects of the invention and their advantages will be discerned when one refers to the following detailed description as taken in conjunction with the drawings, in which.

DETAILED DESCRIPTION OF THE INVENTION

Figure 1:
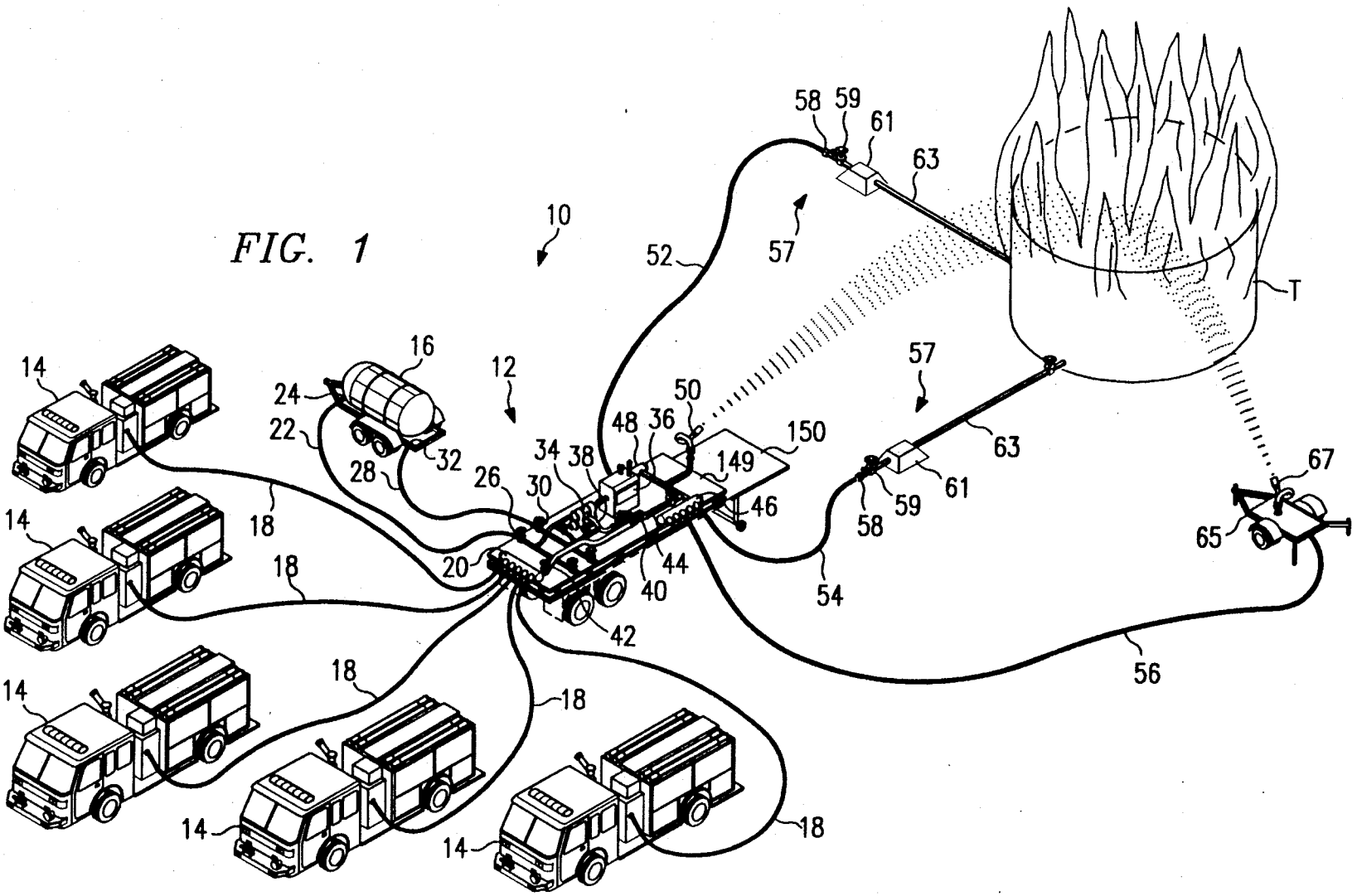
FIG. 1 is an isometric view of a firefighting scene showing a method of fighting a fire according to the invention.

FIG. 1 is an isometric view of a firefighting scene showing a method of fighting a fire according to the invention.

A fire-fighting system, indicated generally at 10, includes a mobile foam generator/pumper unit indicated generally at 12, a plurality of water pumper fire trucks 14, and a portable foam concentrate supply vessel 16. Each of the water pumper vehicles 14 has a 6" water hose 18 which extends from a respective water pump discharge outlet to a respective port of a water intake manifold 20. The water pumper vehicles 14 may be replaced by other pressurized water supplies, such as reservoirs with appropriate water pumping means, portable water vessels, or the like.

The foam concentrate supply vessel 16 is here shown as a wheeled trailer, although it may be a larger semitrailer or a permanent storage structure. A foam concentrate intake line 22 runs from a discharge port 24 on the vessel 16 to a foam concentrate pump intake 26 on the unit 12. Excess foam concentrate that is not immediately used is discharged through a foam concentrate return hose 28, which is connected to a foam concentrate return line port 30 and an intake 32 on the foam concentrate supply vessel 16. Hose 22 should be a hard suction hose, of a variety normally carried on standard water pumpers. Hose 28 may be a 2½" or 3" fire hose of the variety which is standard on fire fighting equipment.

As will be described in more detail in conjunction with FIGS. 2 and 3, the foam concentrate is fed to an intake of a foam concentrate pump 34, which is preferably powered by an on-board diesel engine 36. A foam concentrate discharge 38 is fed to a water/foam proportioner 40, as is a conduit 42 from the water intake manifold 20. A foam solution discharge conduit 44 is connected to each of two foam solution outlet manifolds 46 and 48, and may be further connected to a monitor 50. Fire hoses, such as 5" flexible fire hoses 52, 54, and 56 may be connected to respective ones of a plurality of the foam solution outlets. Fire hoses 52 and 54 are here shown connected to back pressure foam makers indicated generally at 57. Each of the back pressure foam makers 57 will typically include a gate valve 58, a check valve 59, a pipe stanchion 61, and a length of preferably rigid pipe 63 which connects to a port on the tank T that is relatively low on the tank's side. Hose 56 is shown connected to a mobile monitor vehicle 65 having a large monitor 67 mounted thereon. The monitor 50 may be used to spray foam directly from the unit 12. In the illustrated embodiment, the unit 12 is shown mounted on a flatbed semitrailer. Other forms of the unit 12 are possible, such as a skid without a trailer but including lifting eyes, a framework bolted to a trailer which may be pulled by a pickup truck, and other mobile forms.

The foam concentrate inlet 26 to the unit 12 is connected to a portable foam concentrate tanker or nurse trailer 16 by a hard suction fire hose. Such hose is carried on all standard water pumpers. The foam concentrate return port 30 is connected to the foam concentrate nurse trailer 16 by a standard 2½" or 3" fire hose 28. Such hose is carried on all standard water pumpers. The foam concentrate intake port 26, the foam concentrate return port 30, and the foam solution outlet manifolds 46 and 48 are duplicated on both sides of the unit 12 to alleviate logistical and snarling problems.

Additionally, the diesel engine driver 36 disposed on the platform or trailer 12 powers only the foam pump 34. Conventional fire suppression devices, such as foam trucks, utilize a large diesel driver to drive both the foam pump and the vehicle which transports the apparatus. Using a small engine for one purpose provides for an efficient means of delivering large quantities of foam suppression material at high delivery rates and densities.

Figure 2A:
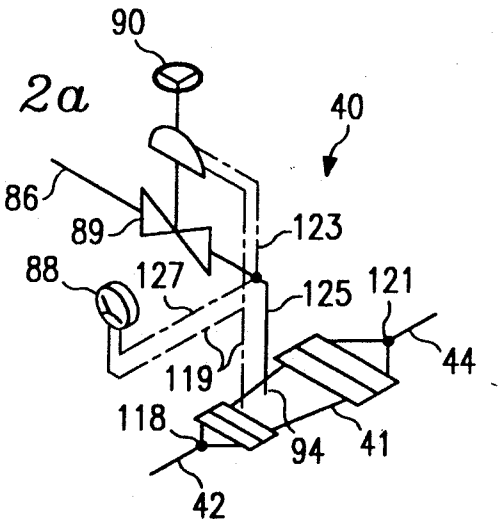
FIG. 2*a* is a more detailed schematic diagram showing components of an in-line balanced pressure proportioning module shown as a portion of the apparatus illustrated in FIG. 2.
Figure 2:
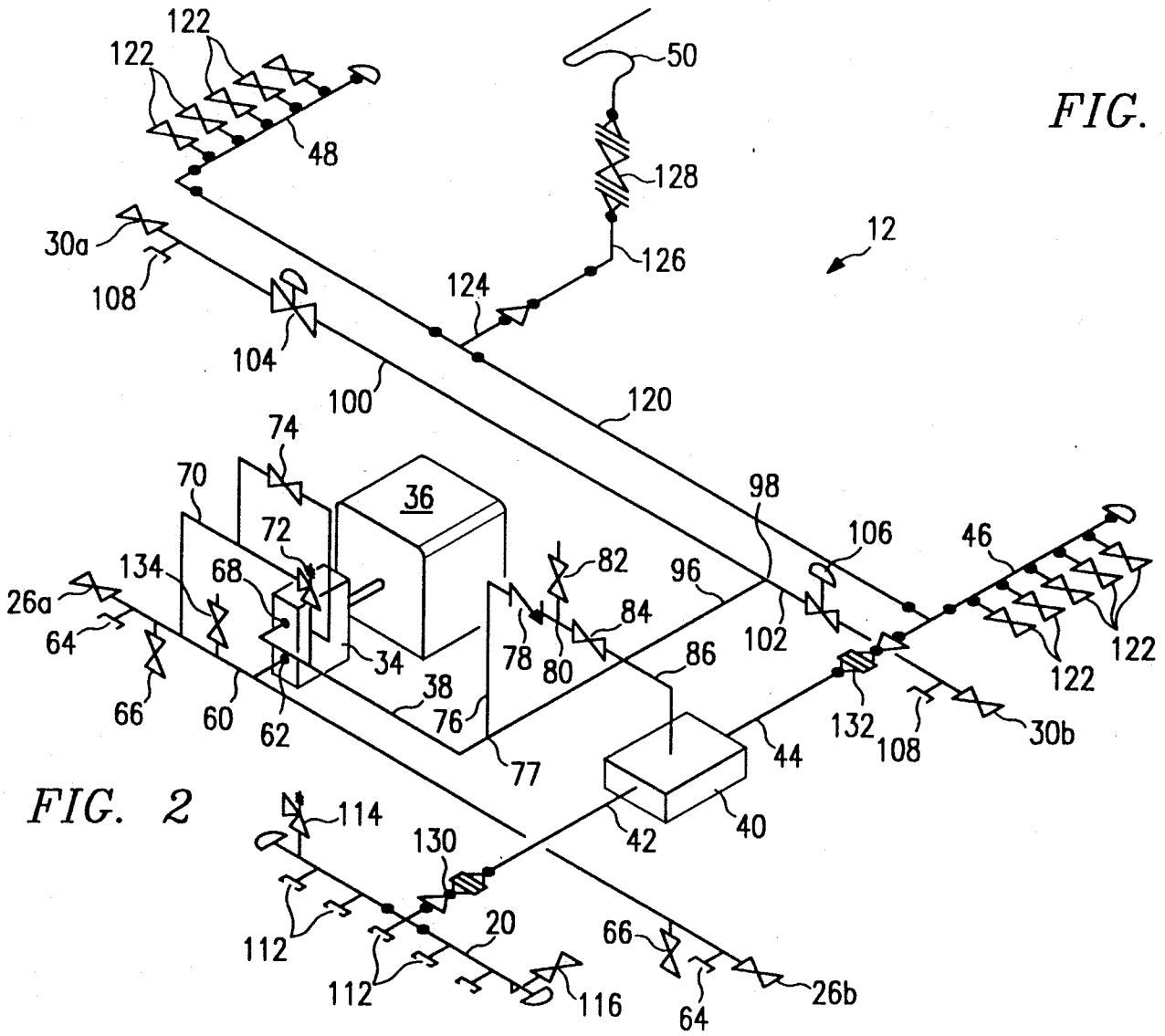
FIG. 2 is a schematic diagram of a first embodiment of a mobile modular foam fire suppression apparatus according to the invention.

FIG. 2 is a schematic diagram of the mobile modular fire suppression apparatus indicated generally at 12. It should be understood that the apparatus 12 may stand alone as an independent mobile fire suppression apparatus, or it may be used in addition to a fixed system of fire suppression equipment to provide adequate capacity. It should also be understood that two modules 12 could be used on the same skid or trailer, side by side, sharing a single foam pump 34 for delivering quantities of foam solution up to 10,000 GPM.

Apparatus 12 has a positive displacement foam concentrate pump 34 preferably powered by a diesel engine 36. An end of a 3" foam concentrate inlet pipe 60 is connected to a foam concentrate inlet or intake 62 of the pump 34. Inlet pipe 60 carries foam concentrate from supply sources to the pump 34. Inlet pipe 60 is preferably branched to either side of the platform (see FIG. 3) and is connected at its ends through gate valves **26*a* and 26*b* to foam concentrate supply sources, such as a tanker or nurse trailer (not shown; see FIG. 1). Two and one-half-inch flush-in connections 64 and ¾" valve drains 66 are located near gate valves 26*a* and 26*b* of foam concentrate inlet pipe 60**.

A 2½" rigid foam concentrate discharge pipe 38 has a first end connected to the discharge 68 of foam pump 34.

Pipe 38 extends outwardly from the pump 34. A 3" foam concentrate pump bypass pipe 70 is connected between foam concentrate discharge line 38 and foam concentrate inlet pipe 60. A pressure release valve 72 is inserted into pump bypass line 70. A bypass valve 74 is inserted between points on pump bypass line 70 to circumvent valve 72 for ease in starting the engine 36 without a clutch.

A pipe segment 76 has a first end joined at a "T" connection or junction 77 with the foam concentrate discharge line 38. A second end of the pipe segment 76 is connected to a check valve 78. The check valve 78 is in turn connected to a pipe tee 80 having a pressure indicator 82. A valve 84 connects pipe tee 80 to a pipe segment 86, which in turn is connected to an in-line balanced pressure proportioning module indicated schematically at box 40.

A 2½" diameter foam concentrate pipe segment 96 extends from union or "T" 77 to a union or "T" connection 98. From here, the foam concentrate return pipe system branches into a first 2½" diameter pipe segment 100 which extends to a first side of the skid or vehicle, and a 2½" diameter pipe segment 102 which extends to a second, opposite side of the platform or vehicle (see FIG. 3). In the illustrated embodiment, foam concentrate pipe segment 100 has a pressure regulating valve 104 which regulates the pressure of the foam concentrate fluid inside that portion of the foam concentrate return pipe segment 100 upstream of valve 104 at or above a predetermined pressure. This pressure is selected to be more than the pressure of the water introduced to the proportioner 40 discussed below. A similar pressure regulating valve 106 is inserted into the other lateral pipe segment 102, set to the same trigger pressure. In an alternative embodiment, the pressure regulating valves 104 and 106 are replaced by a single pressure regulating valve (not shown; see FIG. 3) somewhere in the foam concentrate return pipe segment 96 before it branches off to either lateral side of the vehicle or skid. In yet another embodiment, a "T" connection can be made to pipe 100 between valve 100 and flush-out connection 108, and an additional pipe segment (not shown) may be routed from this "T" connection back to the right side of the trailer, to make a connection to flush-out connection 108 and port 30*b*. The "T" connection 98 would be replaced with a left elbow, and valve 106 would be omitted.

Each lateral pipe segment 100 and 102 is equipped with a flush-out connection 108 and, preferably, a threaded hose termination 30*a* or 30*b* adaptable to be attached to lines running to one or more foam concentrate supply vessels (see FIG. 1).

The preferably 10" diameter water inlet pipe manifold 20 is capable of receiving water from up to five pressurized water sources, such as up to five municipal water pumper trucks, with five clappered 6" inlets 112. The inlets 112 for manifold 20 may have 5" Storz connections, and may be turned down 30° for ease in hose connection. At one end of manifold 20 is an auto air release 114. At this or the other end of manifold 20 is an auto drain 116.

An 8" line 42, which should preferably be rigid pipe and at least 8" in diameter, connects the manifold 20 to the proportioner 40. The proportioning module 40 automatically balances the foam concentrate pressure with the water pressure to provide correct proportioning over a broad range of flow conditions, such as 850–5000 GPM. A preferably 8" rigid foam solution discharge pipe 44 carries the resulting foam solution from the proportioner module 40 through a gate valve 132 to a 10" diameter rigid lateral foam solution discharge pipe 120. Branches of the foam solution discharge pipe 120 preferably extend to opposite sides of the skid or trailer (see FIG. 3). Ten-inch foam solution outlet manifolds 46 and 48 are located at remote ends of the 10" lateral foam solution discharge pipe 120. Each manifold 46 and 48 has up to five 6" outlets 122 gated with 5" Storz connections and turned down 30° to be better adapted for connection to firefighting hoses.

Centrally located on lateral pipe 120 is a T-connection 124 that connects one end of a preferably 8" pipe 126. Pipe 126 is terminated by a valve 128 and a foam monitor or deck gun 50 mounted thereon. Monitor 50 allows the discharge of foam solution directly from the skid or vehicle.

FIG. 2*a* is a detail of the in-line balanced pressure portioning module 40. Water pipe 42 connects to a water inlet port 118 of a ratio controller 41. Ratio controller 41 has a foam solution outlet 121 which is connected to foam solution discharge pipe 44. Foam concentrate pipe 86 is connected to a diaphragm pressure balancing valve 89 which is equipped with a manual override 90. The other side of balancing valve 89 is connected by a suitable pipe connection to form a concentrate inlet 94 of the ratio controller 41. A water sense line 119 is connected to a point on ratio controller 41 near the water inlet 118, and senses water pressure. Branches of the water sense line 119 are connected to a duplex pressure gauge 88 and a diaphragm pressure balancing valve 89. A foam concentrate pressure sensing line 123 is connected from a point 125 on the foam concentrate line 86 to the diaphragm pressure balancing valve 89. A branch 127 of the foam concentrate pressure sensing line may be connected from point 125, or a point close thereto, to the duplex pressure gauge gate 88. In the embodiment shown in FIG. 2*a*, the diaphragm pressure balancing valve 89 acts to balance the foam concentrate pressure at port 94 and the water pressure at port 118. In case there is a malfunction of valve 89, the manual override 90 is provided such that the difference in pressures between the foam concentrate in pipe 86 and the water in pipe 42 may be regulated manually.

A manual valve 130 is inserted into line 42 between the water inlet 118 of the proportioning module and the water inlet manifold 20. Another valve 132 is placed in foam solution discharge pipe 44 before it meets with lateral foam solution discharge pipe 120. The pressure or vacuum of foam concentrate inlet line 60 may be measured with the assistance of a pressure indicating gauge 134.

Another embodiment utilizes two proportioners 40 such as in-line balanced pressure proportioning modules on the same skid or vehicle, side by side. With these proportioners sharing the single foam pump, this apparatus can be sized to proportion any quantity of foam up to 10,000 GPM.

Figure 3:
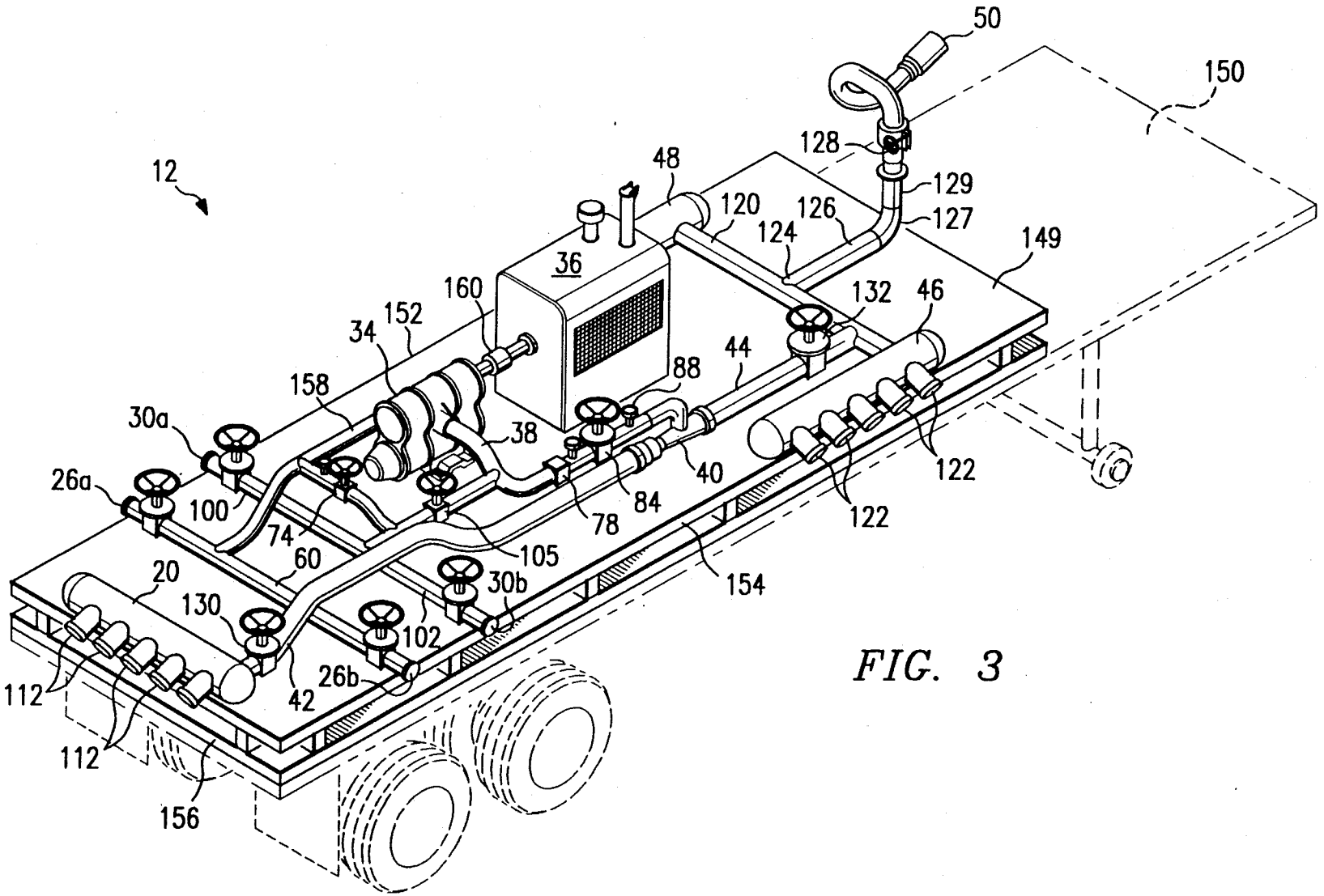
FIG. 3 is a perspective view of one possible physical layout of the major components of the apparatus schematically shown in FIG. 2.

An exemplary physical layout of a unit 12 is isometrically shown in FIG. 3. In the illustrated embodiment, unit 12 includes a skid 149 which has been bolted onto a semitrailer 150. The unit 12 may also take the form of a skid mounted on a smaller trailer adaptable to be pulled by a pickup truck or may be mounted on a skid by itself and provided with lifting eyes such that the unit 12 may be emplaced by a construction crane or the like. It is preferred that the unit 12 be manufactured in the form of a skid which, according to the preference of the customer, may be bolted to any of various vehicles, or transported to the fire site by other methods.

The skid 149 has a left lateral side 152, a right lateral side 154, and a rear side 156. Each lateral side 152 and 154 is provided with a foam solution outlet manifold 46 or 48, a foam concentrate inlet 26*a* or 26*b*, and a foam concentrate return line outlet 30*a* or 30*b*. In this way, connections may be easily made to either side of the trailer, enhancing the ease of interconnection to other components of the system and diminishing snarling of the various hydraulic lines.

The foam concentrate lateral inlet line 60 is in this embodiment placed forwardly of the water inlet manifold 20. A pipe 158 is used to connect the foam concentrate inlet lateral pipe 60 to the inlet of foam pump 34. Next forward is the foam concentrate return lateral line 100. The foam pump 34, as connected to the diesel engine 36 by an appropriate axial connection 160, is sited forward of the foam concentrate lateral return line 100. A single pressure regulating valve 105, which replaces valves 104 and 106 as depicted in FIG. 2, is placed hydraulically between foam concentrate pump discharge line 38 and the lateral foam concentrate return line 100. Physically, it may be sited along side of the foam pump 34.

The proportioning module 40 is placed along side the diesel engine 36. A foam solution discharge pipe 44 is connected to the lateral foam solution discharge pipe 120 that is in this embodiment located forward of the diesel engine 36. The outlet manifolds 48 and 46 are placed on the lateral sides 152 and 154 to have adequate clearance away from the foam concentrate inlet and outlet ports 26*a*, 26*b*, 30*a*, and 30*b*.

The illustrated embodiment of the invention is equipped with a monitor or deck gun 50. A "T" connection 124 is made to a pipe segment 126, which in turn is connected to an elbow 127. The elbow 127 is fitted to an upstanding pipe segment 129, which in turn is connected to the monitor valve 128. It is preferred to mount the water inlet manifold 20 at the rear of the trailer 150 to place the inlets 112 closest to the water pumper vehicles to which they will be connected, and to have these inlets spaced apart from the remaining inlets and ports on the trailer 150.

Figure 4:
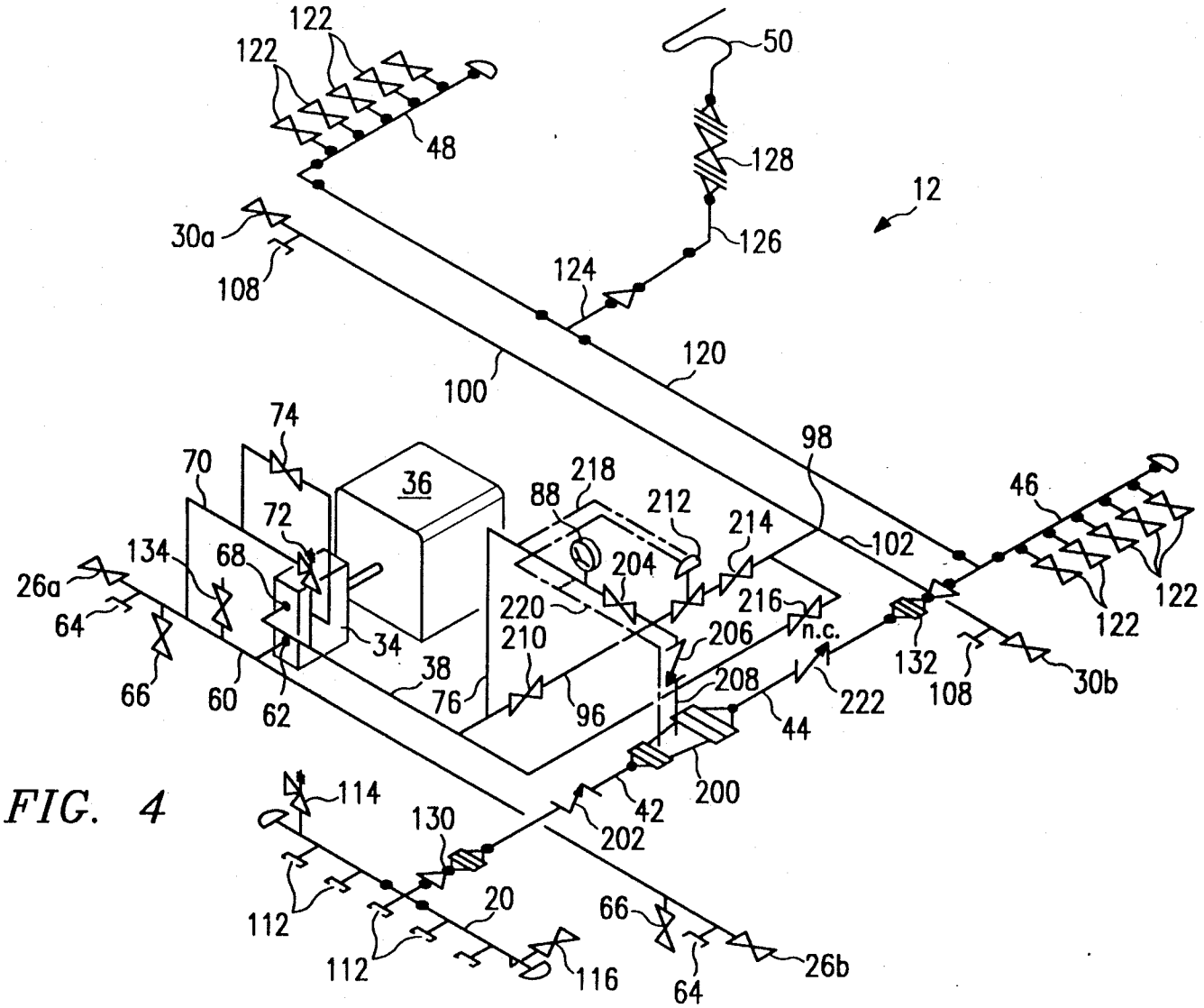
FIG. 4 is a schematic diagram of a second embodiment of a mobile modular foam fire suppression apparatus according to the invention.

FIG. 4 is an isometric hydraulic line diagram of an alternative embodiment of the invention. In this embodiment, the in-line balanced pressure proportioner 40, the duplex gauge 88, and manual override 90 and the pressure regulating valves 104 and 106 are replaced by a ratio controller 200 and associated equipment. The 8" line 42 connects the manual valve 130 to a check valve 202, and connects check valve 202 to a water inlet of the ratio controller 200. The 2½" foam concentrate discharge pipe 38 and 76 connects the foam concentrate discharge of foam pump 34 to a valve 204, which in turn is connected to a check valve 206. Check valve 206 is connected by an 8" line 208 to a foam concentrate inlet of the ratio controller 200. As water passes through a jet at the inlet of the ratio controller 200, it creates a reduced pressure area between the jet and the downstream section called a throat or receiver. This reduction in pressure causes foam liquid to flow through a foam liquid metering orifice and into the reduced pressure area.

As the water flow through the ratio controller 200 increases, so does the level of pressure reduction, thereby affecting a corresponding pressure drop across a foam solution metering orifice of the ratio controller 200. This corresponding pressure drop results in a foam solution flow which is proportionate to the water flow through the ratio controller 200. As the water and foam liquid concurrently flow into a common reduced pressure area, it is necessary only to maintain identical water and foam liquid pressures at the respective inlets of the ratio controller 200. The foam solution metering orifice of the ratio controller 200 is connected to foam solution outlet pipe 44.

A valve 210 is inserted into foam concentrate line 96 before a diaphragm control valve 212. Another gate valve 214 is inserted into the line 96 between the diaphragm control valve 212 and the T-connection 98 to the lateral foam concentrate return lines 100 and 102. A normally closed bypass valve 216 is connected from a point before the valve 210 to a point after the gate valve 214.

A foam concentrate sense line, shown by a dotted and dashed line 218, is connected between the foam concentrate line 76 and a port on the diaphragm control valve 212. The foam concentrate sense line is of relatively small diameter. This or another foam concentrate sense line may be connected to duplex gauge 88. A water pressure sense line 220, also of relatively small diameter and also shown by a dotted and dashed line, is connected to a port on the diaphragm control valve 212, the duplex gauge 88, and a sense port on the ratio controller 200. A check valve 222 is inserted into the foam solution outlet of ratio controller 200 and the foam solution valve 132.

In operation, equal pressures are maintained by the automatic diaphragm control valve 212 in order to assure proper mixing of the water at the water inlet ratio controller 200 and foam concentrate at the foam concentrate inlet thereof.

This apparatus can be sized to produce five different solution flow rates using ratio controllers available in the market: 152 to 180 GPM, 70 to 450 GPM, 150 to 1200 GPM, 1520 to 2500 GPM, and 850 to 5000 GPM.

In summary, the invention is designed to deliver large quantities of 3% foam solution to multiple dispensing appliances, including lines connected to one or more monitors 50 or 67, sprinklers, foam chambers, or high back-pressure foam makers 57 for subsurface injection. The apparatus allows up to five standard water pumper fire trucks to hook up to the water inlet manifold 20 and provide large quantities of water necessary for high capacity foam solution delivery. Water supplied to the 10" water inlet manifold 20 may be from standard water pumpers pumping at a combined rate of up to 5000 GPM.

While preferred embodiments of the invention have been disclosed in the above detailed description, the invention is not limited thereto but only by the scope and spirit of the appended claims.

What is claimed is:

1. A mobile modular fire suppression apparatus comprising:

a movable platform;

a remote supply of foam concentrate;

a foam concentrate pump mounted on said platform and having an inlet and an outlet, and operable to pump the foam concentrate of said remote foam concentrate supply from said inlet to said outlet;

means mounted on said platform and coupled to said pump for powering said pump;

a water/foam proportioner having a water inlet, a foam concentrate inlet, and a foam solution outlet, said proportioner being mounted on said platform, said foam concentrate inlet being coupled to said outlet of said pump;

a water intake manifold mounted on said platform and having a plurality of water intakes, said intake manifold having an outlet coupled to said water inlet of said proportioner;

a plurality of foam solution outlets mounted on said platform and coupled to said foam solution outlet of said proportioner; and a first foam concentrate conduit coupling said outlet of said pump to said foam concentrate inlet of said proportioner, a second foam concentrate conduit having a first end communicating with said pump outlet and at least one second end, said second end being operable to be coupled to said remote supply of the foam concentrate for delivery of the foam concentrate thereto, and a pressure regulator interposed between said first end and said second end of said second foam concentrate conduit for regulating a fluid pressure of the foam concentrate in a portion of said second conduit between said first end and said pressure regulator to be above a pressure of water in said water intake manifold.

2. The apparatus of claim 1, wherein said platform has two opposed sides, said second conduit has a first branch connected to said second end and mounted adjacent a first of said opposed sides of said platform, and a second branch of said second conduit has a third end remote from said first and second ends and mounted adjacent a second of said opposed sides of said platform.

3. A mobile modular foam fire suppression apparatus comprising:

a movable platform;

a foam concentrate pump mounted on said platform and having an inlet and an outlet, and operable to pump foam concentrate from said inlet to said outlet;

means mounted on said platform and coupled to said pump for powering said pump;

a water/foam proportioner having a water inlet, a foam concentrate inlet, and a foam solution outlet, said proportioner being mounted on said platform, said foam concentrate inlet being coupled to said outlet of said pump;

a water intake manifold mounted on said platform and having a plurality of water intakes, said intake manifold having an outlet coupled to said water inlet of said proportioner;

a plurality of foam solution discharge outlets mounted on said platform and coupled to said foam solution outlet of said proportioner; and a foam concentrate intake conduit coupled to said inlet of said pump, said conduit being operable to be connected to a remote supply of foam concentrate for intake of the foam concentrate therefrom;

said platform having two opposed sides, a first branch of said foam concentrate conduit having an end mounted adjacent a first of said sides, and a second branch of said foam concentrate conduit having an end mounted adjacent a second of said sides.

4. A mobile modular foam fire suppression system comprising:

foam generating and pumping apparatus mounted on a single mobile platform, said apparatus including:

a foam concentrate pump having a foam concentrate intake and a foam concentrate discharge;

means for powering said pump;

a foam/water proportioner having a foam concentrate inlet coupled to said foam concentrate discharge of said pump, a water inlet, and a foam solution outlet;

a water intake manifold including a plurality of water intakes, an outlet of said manifold being coupled to said water inlet of said proportioner; and at least one foam solution discharge conduit coupled to said foam solution outlet of said proportioner;

at least one water pumper vehicle coupled to one of said water intakes of said water intake manifold for supplying water to said proportioner; and a portable foam concentrate supply, a foam concentrate conduit coupling said portable supply to said intake of said pump for supplying concentrate thereto.

5. The fire suppression system of claim 4, and further comprising:

a second foam concentrate conduit coupling said portable supply to said discharge of said pump for recycling of unused foam concentrate to said portable supply.

6. The fire suppression system of claim 4, wherein said foam concentrate portable supply comprises a foam concentrate vessel mounted on a vehicle.

7. The fire suppression system of claim 4, and further comprising a plurality of water pumper vehicles coupled to respective ones of said intakes of said water intake manifold.

8. Mobile modular fire suppression apparatus comprising:

a platform having first and second opposed sides, and a third side connecting said first and said second sides;

a foam concentrate pump mounted on said platform and having a foam concentrate intake and a foam concentrate discharge;

a pump engine mounted on said platform and coupled to said pump to supply motive power to said pump;

first and second foam concentrate intake conduits each having a first end coupled to said intake of said pump, a second end of said first conduit being mounted on said platform adjacent said first side, and a second end of said second conduit being mounted on said platform adjacent said second side;

a proportioner having a water inlet, a foam concentrate inlet, and a foam solution outlet, said foam concentrate discharge of said pump being coupled to said foam concentrate inlet of said proportioner;

a water intake manifold mounted on said platform adjacent said third side, said manifold having a plurality of water inlet ports and a water outlet, said outlet of said manifold being coupled to said water inlet of said proportioner; and a branched foam solution discharge conduit having a first end coupled to said foam solution outlet of said proportioner, a first port of said branched conduit being in communication with said first end thereof sand mounted on said platform adjacent said first side, a second port of said branched conduit being in communication with said first end thereof and mounted on said platform adjacent said second side, and said first and second ports of said foam solution discharge conduits each having a plurality of foam solution outlets.

9. The fire suppression apparatus of claim 8, and further comprising a foam concentrate return conduit having a first end coupled to said foam concentrate discharge of said pump and said foam concentrate inlet of said proportioner, a second end of said foam concentrate return conduit being disposed adjacent one of said first and second sides of said platform, said second end of said foam concentrate return conduit being adaptable to be connected to a foam concentrate supply vessel; and a pressure regulating valve forming a portion of said foam concentrate return conduit between said first and second ends thereof and being operable to regulate a pressure at said foam concentrate inlet of said proportioner to be at or above at predetermined value.

10. The fire suppression apparatus of claim 9, wherein said foam concentrate return conduit is branched, and wherein a third end of said foam concentrate return conduit remote from said first and second ends of said foam concentrate return conduit is mounted adjacent a second one of said first and second sides.

11. The fire suppression apparatus of claim 8, and further comprising a monitor having an inlet coupled to said foam solution discharge conduit and being mounted on said platform for discharging foam solution directly from said platform.

12. The fire suppression apparatus of claim 8, and further comprising a bypass conduit having a first end coupled to said foam concentrate intake of said pump and a second end coupled to said foam concentrate discharge of said pump, and a normally closed bypass valve forming a portion of said bypass conduit and disposed between said first and second ends of said bypass conduit.

13. The fire suppression apparatus of claim 8, and further comprising flush-in connections opening on respective ones of said first and second foam concentrate intake conduits, at least one foam concentrate return conduit coupled to said foam concentrate discharge, and at least one flush-out connection opening onto said foam concentrate return conduit.

14. The fire suppression apparatus of claim 13, and further comprising first and second foam concentrate return ports coupled to said foam concentrate return conduit and mounted on said first and second sides, respectively, said at least one flush-out connection being mounted near said first foam concentrate return port, and a second flush-out connection mounted near said second foam concentrate return port.

15. A method for fighting a fire with foam solution, comprising the steps of:

mounting a foam concentrate pump and a means for providing motive power to the pump on a mobile platform;

connecting an outlet of the pump to a foam concentrate inlet of a foam/water proportioner mounted on the platform;

coupling a water inlet of the proportioner to respective water conduits of each of a plurality of water pumper vehicles spaced from the platform;

coupling an inlet of the foam concentrate pump to a foam concentrate supply vessel spaced from the platform;

coupling a foam solution outlet of the proportioner to at least one foam solution discharge means;

responsive to said steps of connecting and coupling, pumping foam concentrate from the foam concentrate supply vessel to the proportioner;

responsive to said step of coupling the water inlet of the proportioner, using the pumper vehicles to pump water to the proportioner;

responsive to said steps of pumping the foam concentrate from said foam concentrate supply vessel and using the pumper vehicles to pump the water from said water pumper vehicles to said proportioner, using said proportioner to generate said foam solution form the foam concentrate and the water; and using the foam solution discharge means, spraying the fire with said foam solution generated by said proportioner.

16. The method of claim 15, and further comprising the steps of:

returning excess foam concentrate from the outlet of the pump to the foam concentrate supply vessel; and regulating a pressure of a foam concentrate return line with a pressure regulating valve in order to insure that the pressure of the foam concentrate as it enters the proportioner is at least a predetermined pressure.

17. The method of claim 15, wherein the foam discharge means includes a plurality of foam solution discharge outlets, said method further comprising the step of transporting said foam solution to the fire with each of a plurality of conduits connected to respective ones of the foam solution discharge outlets mounted on the platform.

18. The method of claim 17, and further comprising the steps of:

mounting at least one of the foam solution discharge outlets on a first side of the mobile platform;

mounting at least a second of the foam solution discharge outlets on a second side of the platform opposed from the first side;

connecting respective first and second foam discharge conduits to said first and second foam solution discharge outlets; and spraying the fire with said foam solution using the first and second foam discharge conduits.

19. The method of claim 15, wherein the foam solution discharge means includes a flexible fire hose.

20. The method of claim 15, wherein the platform is mounted on a wheeled vehicle.

21. The method of claim 15, and further comprising the step of mounting the supply vessel on a wheeled vehicle.

22. The method of claim 15, and further comprising the step of mounting a water intake manifold on a side of the platform; and using the water intake manifold to attach ends of the respective water conduits to the water inlet of the proportioner.

* * * * *